US008344663B2

(12) United States Patent
Trattler et al.

(10) Patent No.: US 8,344,663 B2
(45) Date of Patent: Jan. 1, 2013

(54) CIRCUIT ARRANGEMENT AND METHOD FOR CONTROLLING AT LEAST ONE LIGHT SOURCE

(75) Inventors: Peter Trattler, Graz (AT); Manfred Pauritsch, Graz (AT)

(73) Assignee: Austriamicrosystems AG, Unterpremstatten (AT)

( * ) Notice: Subject to any disclaimer, the term of this patent is extended or adjusted under 35 U.S.C. 154(b) by 813 days.

(21) Appl. No.: 12/227,027

(22) PCT Filed: May 4, 2007

(86) PCT No.: PCT/EP2007/003969

§ 371 (c)(1),
(2), (4) Date: Aug. 11, 2009

(87) PCT Pub. No.: WO2007/128528

PCT Pub. Date: Nov. 15, 2007

(65) Prior Publication Data

US 2009/0302769 A1 Dec. 10, 2009

(30) Foreign Application Priority Data

May 4, 2006 (DE) ..... 10 2006 020 839

(51) Int. Cl.
*H05B 37/00* (2006.01)
*G05F 1/00* (2006.01)

(52) U.S. Cl. ..... 315/312; 315/291

(58) Field of Classification Search ..... 315/291, 315/307, 308, 312, 244, 246, 209 R, 160, 315/210, 211, 185 R, 192
See application file for complete search history.

(56) References Cited

U.S. PATENT DOCUMENTS

| | | | | |
|---|---|---|---|---|
| 5,715,049 | A * | 2/1998 | Ohsuka et al. | 356/215 |
| 5,886,778 | A * | 3/1999 | Kasai et al. | 356/72 |
| 5,959,291 | A | 9/1999 | Jensen | |
| 5,995,858 | A * | 11/1999 | Kinast | 600/323 |
| 6,127,783 | A | 10/2000 | Pashley et al. | |
| 6,169,618 | B1 * | 1/2001 | Higashino | 398/197 |
| 6,441,558 | B1 * | 8/2002 | Muthu et al. | 315/149 |
| 6,495,964 | B1 * | 12/2002 | Muthu et al. | 315/149 |
| 6,498,334 | B2 * | 12/2002 | Feng | 250/214 A |
| 6,498,440 | B2 | 12/2002 | Stam et al. | |
| 6,894,442 | B1 | 5/2005 | Lim et al. | |
| 6,963,767 | B2 * | 11/2005 | Rantala et al. | 600/336 |
| 7,030,574 | B2 * | 4/2006 | Lim et al. | 315/312 |
| 2005/0116662 | A1 | 6/2005 | Sanchez | |
| 2006/0049332 | A1 | 3/2006 | Vornsand et al. | |
| 2006/0062108 | A1 | 3/2006 | Muthu | |

FOREIGN PATENT DOCUMENTS

| | | |
|---|---|---|
| DE | 10 2004 047 669 | 4/2006 |
| EP | 1589519 | 10/2005 |
| WO | WO 03/037042 | 5/2003 |

* cited by examiner

*Primary Examiner* — Minh D A
(74) *Attorney, Agent, or Firm* — Cozen O'Connor

(57) ABSTRACT

A circuit arrangement for controlling at least one light source comprises a photodetector (2), a sampling circuit (6) for selectively sampling a photodetector signal (lin2) generated by the photodetector (2) as a function of a first and a second light source (10, 12), and a control unit (5), which is coupled on the input side to the sampling circuit (6). The circuit arrangement further comprises a first power-supply source (7), which is coupled to the control unit (5) and is designed for controlling at least one parameter of a first light source (12), and at least one second power-supply source (11), which is coupled to the control unit (5) and is designed for controlling at least one parameter of a second light source (12). The circuit arrangement is suitable, for example, for RGB lighting.

26 Claims, 5 Drawing Sheets

CIRCUIT ARRANGEMENT AND METHOD FOR CONTROLLING AT LEAST ONE LIGHT SOURCE

RELATED APPLICATIONS

This is a U.S. national stage of application No. PCT/EP2007/003969, filed on 4 May 2007.

This patent application claims the priority of German patent application no. 10 2006 020 839.0 filed 04 May 2006, the disclosure content of which is hereby incorporated by reference.

FIELD OF THE INVENTION

The present invention relates to a circuit arrangement for controlling at least one light source, a use of the circuit arrangement, and a method for controlling at least one light source.

BACKGROUND OF THE INVENTION

In lighting arrangements, several light sources can be used together, such as a red and a white light emitting diode, abbreviated LED. A use of three light emitting diodes, a red, a green, and a blue light emitting diode, is also often encountered for RGB lighting. Such lighting arrangements are used, for example, as backlighting for a liquid crystal display.

In order to test whether such a lighting arrangement outputs light with a given wavelength characteristic, lighting arrangements typically provide several photodetectors, which each have different filters. In this way, the light of a red LED is measured by means of a photodetector, which is covered with a filter layer that is transparent for red light. Photodetectors covered with corresponding filters are also provided for a green and a blue LED. This allows white balance correction.

SUMMARY OF THE INVENTION

One object of the present invention is to provide a circuit arrangement and a method for controlling at least one light source, which can be realized in a cost-efficient and flexible way.

According to an embodiment of the invention, a circuit arrangement for controlling at least one light source comprises a photodetector, a sampling means, a control unit, and also a first and a second power-supply source. The sampling means is coupled on the input side to the photodetector and on the output side to the control unit. The first and the second power-supply source are each coupled at one control input to a first and second output, respectively, of the control unit. A first light source can be coupled to the first power-supply source and a second light source can be coupled to the second power-supply source.

A photodetector signal is generated by the photodetector as a function of the light of the first and the second light source and provided to the sampling means. The sampling means is used for the selective sampling of the photodetector signal. A signal provided by the sampling means is fed to the control unit. Control signals, which are fed to the control inputs of the first and the second power-supply source, are provided by the control unit as a function of the signal fed to the control unit. As a function of the control signals, the first power-supply source supplies electrical energy to the first light source that can be coupled, and the second power-supply source supplies electrical energy to the second light source that can be coupled.

Advantageously, the circuit arrangement can be realized in a cost-efficient way, because the first and the second light source are activated successively and a signal for further processing is provided by the sampling means only when one of the two light sources is activated. Thus, a single photodetector is sufficient for determining brightness and/or color or color temperature of the light sources. Advantageously, the photodetector requires no filter. Thus, it is not necessary to adapt a filter located on the photodetector to the changed wavelengths for the use of light sources with wavelengths different from wavelengths of the original light sources. This increases the flexibility of the circuit arrangement.

In one embodiment, the control unit comprises a first filter, which is coupled on the input side to the sampling means. This first filter is coupled on the output side to the first and to the second output of the control unit. Advantageously, noise that could possibly be generated by the sampling means can be reduced by means of the first filter.

The first filter is advantageously connected downstream of the sampling means. This way prevents the photodetector signal generated as a function of the light of the light source being influenced by the photodetector signal generated as a function of the light of the second light source.

In one preferred embodiment, the first filter can be connected on the input side to the sampling means.

In one embodiment, the first filter can be constructed as a hold circuit or as a sample-and-hold circuit. In this embodiment, a value can advantageously be held at one output of the first filter until another input value is fed to the first filter by the next sampling by means of the sampling means and another value is then held on the output of the first filter.

In one improvement, the circuit arrangement comprises a third power-supply source with an output, to which a third light source can be coupled. For control, the third power-supply source is connected to a third output of the control unit. The light of the third light source also generates the photodetector signal, which is sampled selectively, in order to determine the photodetector signal generated by the third light source.

In one embodiment, the first filter is coupled on the output side to the third output of the control unit.

In one improvement, the circuit arrangement has additional power-supply sources, which are each coupled at a control input to another output of the control unit and which each have an output to which another light source can be coupled, whose light also contributes to the photodetector signal.

In one embodiment, the power-supply sources can each comprise a current source and a switch, which are connected to each other in series.

In one embodiment, the circuit arrangement comprises a sequence control, which is connected to a control input of the sampling means and to additional control inputs of the first, the second, and additional power-supply sources. The sequence controller provides a control signal, which controls, in an adjustment phase, the sequence of activation and deactivation of the power-supply sources and the sampling of the photodetector current, so that the brightness values of the light sources are detected and evaluated in a time sequence. The control signal is used for synchronizing the switches in the power-supply sources and in the sampling means. In one improvement, the sequence controller is also coupled to the control unit, so that the control signal can also be fed to the control unit and is used in the control unit for synchronizing the sampling with the further processing of the sampled signals.

The control unit and the control signals provided by it are used for adjusting the brightness of the light sources by adjusting a parameter of the power-supply sources in an operating phase. The parameter can be a current intensity, a pulse duration, and/or a pulse-duty ratio or a pulse density of a current supplied to a light source from the power-supply source coupled to it.

The photodetector can be a photoresistor, a photodiode, or a phototransistor. Preferably, the photodetector is constructed as a photodiode.

In one embodiment, the sampling means comprises a first sampling circuit, whose input is coupled to the photodetector and whose output is coupled to the control unit. In one embodiment, the sampling means comprises a first sampling circuit, whose input is coupled with the photodetector and whose output is coupled with the control unit. In one embodiment, the first sampling circuit is switched to be conductive when exactly one of the three light sources is activated.

In an alternative embodiment, the first sampling circuit is allocated to the first power-supply source. The sampling means comprises a second sampling circuit, which is allocated to the second power-supply source, and also a third sampling circuit, which is allocated to the third power-supply circuit. In the alternative embodiment, the first sampling circuit is switched to be conductive when the first light source is activated. The second and the third sampling circuits are switched to be conductive when the second and the third light source, respectively, are each activated. In the alternative embodiment, the sequence controller can be designed in such a way that it is connected by means of three bus lines to the three power-supply sources and to the three sampling circuits. Thus, via the first bus line, the first power-supply source can be activated and the first sampling circuit can be switched to be conductive. Via the second and third bus line, the second power-supply source can be activated together with the second sampling circuit or the third power-supply source can be activated together with the third sampling circuit.

In one improvement, a time duration, during which one of the sampling circuits is switched to be conductive, is less than a time duration, during which the corresponding power-supply source is activated.

In one embodiment, the control unit comprises a memory, which is designed for storing a sampled value of the photodetector current for each power-supply source or for storing a value derived from this photodetector current. Alternatively, the memory can also be designed to store a value for each power-supply source, which is determined by means of the control unit from the corresponding measurement value of. the photodetector current and a set point.

The control unit can comprise an analog circuit. In one improvement, the control unit can alternatively or additionally comprise a digital circuit. In one embodiment, the control unit can also comprise a microcontroller.

In one embodiment according to the invention, a lighting arrangement comprises the circuit arrangement and also the first and the second light source. The first light source is connected to the first power-supply source and the second light source is connected to the second power-supply source. Such a lighting arrangement can be used in a lamp whose brightness and whose wavelength characteristics are controlled. The lighting arrangement can comprise the third light source, which is connected to the third power-supply source. The control of the power-supply sources can be used for white balance correction of the lighting arrangement. Such a lighting arrangement can be used advantageously for a display, such as a liquid crystal display.

According to an aspect of the invention, a method for adjusting at least one light source comprises the following steps: a first and a second light source are activated successively. A photodetector current, which is allocated to one of the light sources, is measured and sampled. A first and a second power-supply source, which are provided for the first and second light source, respectively, are controlled as a function of the sampled values of the photodetector current.

Advantageously, the measurement can be performed with a single photodetector based on the selective activation of the light sources and the correspondingly allocated sampling.

In one embodiment, the photodetector current, which is allocated to one of the light sources, is measured, sampled, and filtered. In this way, the sampled photodetector current is filtered.

In one embodiment, the activation of the light sources and the sampling and measuring are performed in an adjustment phase. The power-supply sources are controlled in an operating phase. The adjustment phase can be performed at the beginning of the use of the lighting arrangement. The operating phase follows the completion of the adjustment phase. After a given time duration, the system can be switched from the operating phase back into the adjustment phase. Thus, changes that occur in the lighting arrangement due to temperature or component drift can advantageously be compensated by means of the adjustment phases.

A brightness of one of the light sources can be controlled by setting the current output to the light source from the corresponding power-supply source. Alternatively, the brightness that can be recognized by a viewer from one of the light sources can be controlled by means of pulse-width modulation or pulse-density modulation of the current provided by the corresponding power-supply source of the light source. In this way, a color characteristic of the lighting arrangement can be adjusted by means of a current intensity and/or pulse-duty ratio, with which each of the light sources are provided with electrical energy.

BRIEF DESCRIPTION OF THE DRAWINGS

The invention will be explained in more detail below using several embodiments with reference to the figures. Components that are identical in function or effect carry identical reference symbols. Insofar as circuit parts or components correspond in their function, their description will not be repeated in each of the following figures.

DETAILED DESCRIPTION OF THE DRAWINGS

Figure 1:
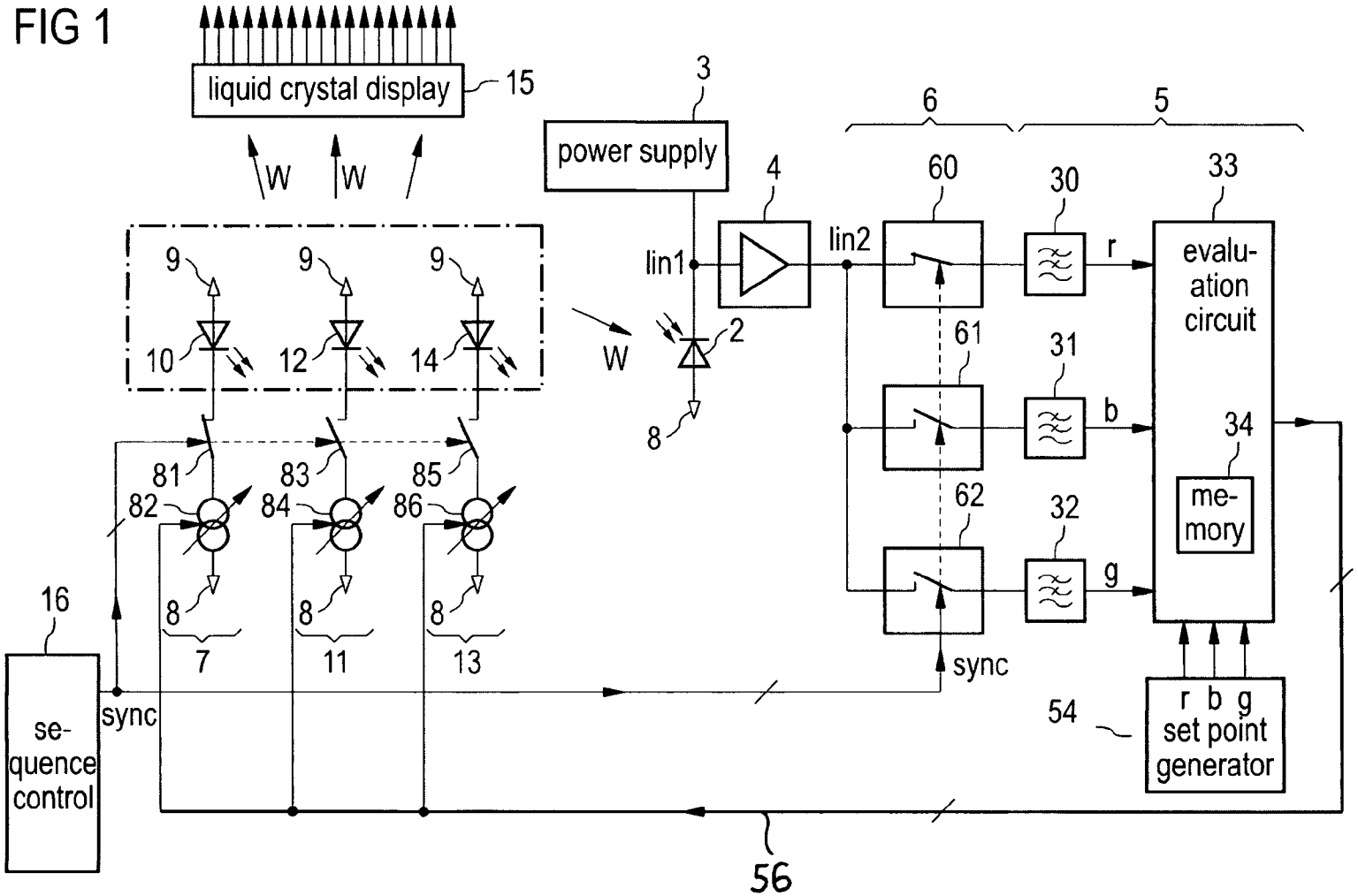
FIG. 1 shows an exemplary embodiment of a lighting arrangement according to the invention.

FIG. 1 shows an exemplary embodiment of a lighting arrangement according to the invention. The lighting arrangement comprises a first, a second, and a third light source 10, 12, 14, and also a photodetector 2, which is arranged in the lighting arrangement in such a way that light from each of the three light sources 10, 12, 14 can be detected by the photodetector 2. The photodetector 2 is constructed as a photodiode and is connected at a first terminal to the reference potential terminal 8 and at a second terminal to a power-supply circuit 3. An input of an optional preamplifier 4 is connected to a node between the photodetector 2 and the power-supply circuit 3. A sampling means 6, downstream of which a control unit 5 is connected, is connected to an output of the preamplifier 4. The sampling means 6 comprises a first, a second, and a third sampling circuit 60, 61, 62, which are connected on the input side to the optional preamplifier 4. The control unit 5 comprises a first filter 30, which is connected on the input side to an output of the first sampling circuit 60, and also a second and a third filter 31, 32, which are connected on the input side to an output of the second and the third sampling circuit 61, 62, respectively. On the output side, the three filters 30, 31, 32 are coupled to an evaluation circuit 33, which comprises a memory 34. In addition, the control unit 5 has a set-point generator 54, which is connected to the evaluation circuit 33.

The lighting arrangement further comprises a first power-supply source 7, which is connected at one output to the first light source 10. The first power-supply source 7 has a switch 81 and a current source 82. The first power-supply source 7 and the first light source 10 form a series circuit, which is connected between a power-supply voltage terminal 9 and the reference-potential terminal 8. The lighting arrangement likewise comprises a second power-supply source 11 and a third power-supply source 13, which are each connected to an output of the second light source 12 and the third light source 14, respectively. The second power-supply source 11 has a switch 83 and a current source 84. Accordingly, the third power-supply source 13 has a switch 85 and a current source 86. The evaluation circuit 33 and thus the control unit 5 are connected at a first, a second, and a third output of the control unit 5 via a bus line 56 to a control terminal of the current source 82 of the first power-supply source 7, to a control terminal of the current source 84 of the second power-supply source 11, and to a control terminal of the current source 86 of the third power-supply source 13. In addition, the lighting arrangement has a sequence controller 16, which is connected on the output side to a control terminal of the switch 81 of the first power-supply source 7, to a control terminal of the switch 83 of the second power-supply source 11, and to a control terminal of the switch 85 of the third power-supply source 13, and to the three sampling circuits 60, 61, 62 of the sampling means 6.

The lighting arrangement is used for backlighting a liquid crystal display 15. The liquid crystal display 15 can have thin-film transistors, abbreviated TFT.

In a first adjustment phase, the sequence controller 16 provides, on the output side, a control signal sync, which is fed to the first power-supply source 7 and also to the first sampling circuit 60. Due to this control signal sync, the first power-supply source 7 and thus the first light source 10 are activated. The light of the first light source 10 falls on the photodetector 2, so that a photodetector signal lin1 is applied to the node between the photodetector 2 and the power-supply circuit 4. The photodetector signal lin1 is amplified by means of the optional preamplifier 4, so that a photodetector signal lin2 is provided at the output of the preamplifier 4. The photodetector signal lin2 is fed on the input side to the first, the second, and the third sampling circuit 60, 61, 62. By means of the control signal sync, the first sampling circuit 60 is switched to be conductive, so that the photodetector signal lin2 is fed to the first filter 30. A signal that can be tapped on the output side at the first filter 30 is fed to the evaluation circuit 33, in which it is compared with a first default value for the first light source 10. The first default value is made available to the evaluation circuit 33 by the set-point generator 54. A value determined as a function of the signal at the output of first filter 30 and as a function of the first default value is stored in the memory 34. In a second adjustment phase, by means of the control signal sync, the first power-supply source 7 and the first sampling circuit 60 are deactivated and the second power-supply source 11 and thus the second light source 12 and also the second sampling circuit 61 are activated. Light generated by the second light source 12 and incident on the photodiode 2 leads to a photodetector signal lin1 and a photodetector signal lin2 amplified by means of the preamplifier 4. The second sampling circuit 61 is switched to be conductive, so that the photodetector signal lin2 can be fed to the evaluation circuit 33 via the second filter 31. The filtered signal is compared to a set point and a signal derived from the comparison is stored in the memory 34. In a corresponding way, the third power-supply source 13 and thus the third light source 14 and also the third sampling circuit 62 are activated by means of the control signal sync in a third adjustment phase. The light generated by the third light source 14 falls on the photodetector 2 and produces the photodetector signal lin2, which is amplified by means of the preamplifier 4 and which is fed to the third filter 32 via the third sampling circuit 62. As a function of a value on the output of the third filter 32 and a set point made available by the set-point generator 54, a value is formed that is stored in the memory 34.

In one operating phase, control signals are fed from the control unit 5 via the bus line 56 to the control inputs of the current sources 82, 84, 86 of the first, the second, and the third power-supply sources 7, 11, 13, respectively. The control signals can be formed as a function of the values stored in the memory 34. In this way, three values of the photodetector signal are generated based on the selective sampling of the three light sources, wherein these three values are provided to the evaluation circuit 33 after filtering by means of the first, the second, and the third filter 30, 31, 32, so that, in the following operating phase, setting parameters can be fed to the three power-supply sources 7, 11, 13 as a function of the stored values. This advantageously has the effect that the light output from the three light sources 10, 12, 14 corresponds to the default values.

In one alternative embodiment, the preamplifier 4 and the power-supply circuit 3 can be left out, the photodetector 2 then being connected directly between the reference potential terminal 8 and the input of the sampling means 6.

FIGS. 2A to 2D show exemplary embodiments of a sampling circuit and a filter, of the type that could be used in FIG. 1 as the first sampling circuit 60 and as the first filter 30, as the second sampling circuit 61 and as the second filter 31, and also as the third sampling circuit 62 and the third filter 32.

Figure 2A:
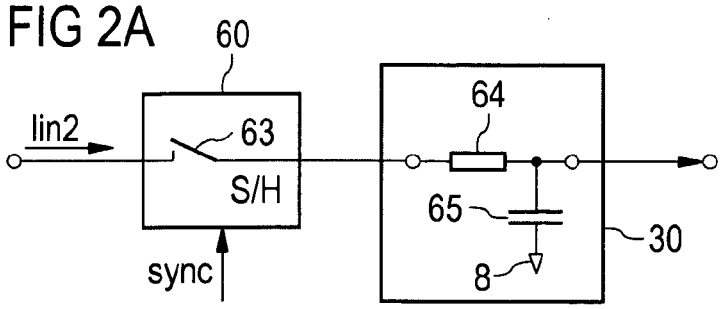
FIGS. 2A to 2D show exemplary embodiments of a sampling means and a filter.

FIG. 2A shows a sampling circuit 60, which is constructed as a sample-hold circuit and which comprises a switch 63. The filter 30 is constructed as a low-pass filter and comprises an RC element with a resistor 64 and a capacitor 65.

Figure 2B:
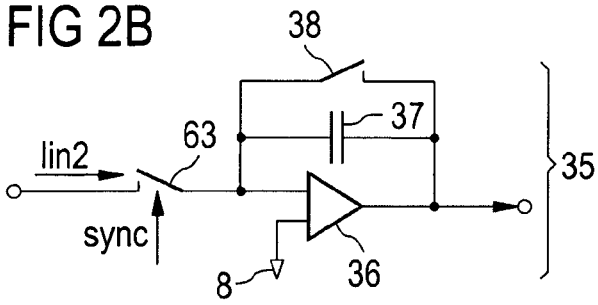

FIG. 2B shows a sampling circuit, which has the switch 63, and a filter, which is realized by means of an integrator 35. The integrator 35 comprises an amplifier 36, a capacitor 37, and a switch 38. A first input of the amplifier 36 is connected to the reference potential terminal 8. A second input of the amplifier 36 is connected to the switch 63 and also, via a parallel circuit, which comprises the capacitor 37 and the switch 38, to an output of the amplifier 36. The output of the amplifier 36 forms the output of the integrator 35, which is coupled to the evaluation circuit 33 not shown in FIG. 2B.

By closing the switch 38, the capacitor 37 is discharged and the integrator 35 is thus reset. If the switch 63 is switched by means of the control signal sync from an open into a closed state, then the capacitor 37 is charged by the photodetector current lin2. A voltage on the output of the integrator 35 is thus proportional to the intensity of the photodetector current lin2 and the adjustable duration, during which the switch 63 is closed. The voltage is further processed by the evaluation circuit 33. Alternatively, the switch 63 can also be closed multiple times for the given time, so that the voltage on the output of the integrator 35 represents an integrated average value of the photodetector current lin2. The switch is controlled by the control signal sync, which is provided by the sequence controller 16. By means of the control signal sync, how many times and for what time duration the switch 63 is closed can be set.

Figure 2C:
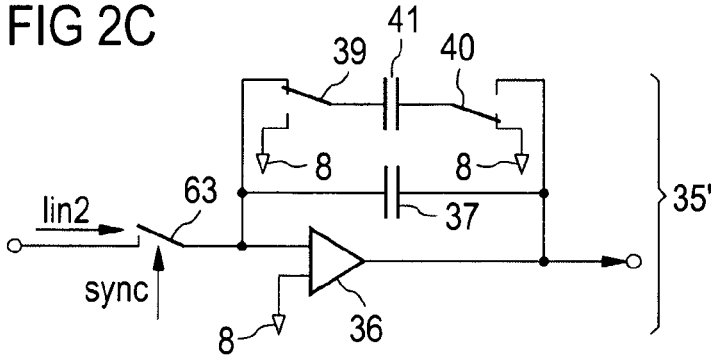

FIG. 2C shows a sampling circuit, which comprises the switch 63, and a filter, which has an integrator 35'. The integrator 35' comprises the amplifier 36, the capacitor 37, and another capacitor 41, as well as two change-over switches 39 and 40. The integrator 35' is constructed as a switched capacitor circuit. One input of the integrator 35' is connected to the output of the switch 63 and to the second input of the amplifier 36. The first input of the amplifier 36 is connected to the reference-potential terminal 8. The two change-over switches 39 and 40 are connected in series with the additional capacitor 41, wherein the additional capacitor 41 is arranged between the change-over switch 39 and the change-over switch 40. This series circuit is connected in parallel to the capacitor 37. This parallel circuit connects the second input of the amplifier 36 to the output of the amplifier 36, which simultaneously forms the output of the integrator 35', which is connected to the evaluation circuit 33. The series circuit, comprising the additional capacitor 41 and the two change-over switches 39, 40, takes on the function of a resistor. The change-over switch 39 switches one electrode of the capacitor 41 between the second input of the amplifier 36 and the reference-potential terminal 8 and the change-over switch 40 switches another electrode of the capacitor 41 between the output of the amplifier 36 or the reference-potential terminal 8. Only one of the two electrodes of the capacitor 41 is always connected to the reference-potential terminal 8. By means of the frequency of the change-over, the resistance value can be set.

Figure 2D:
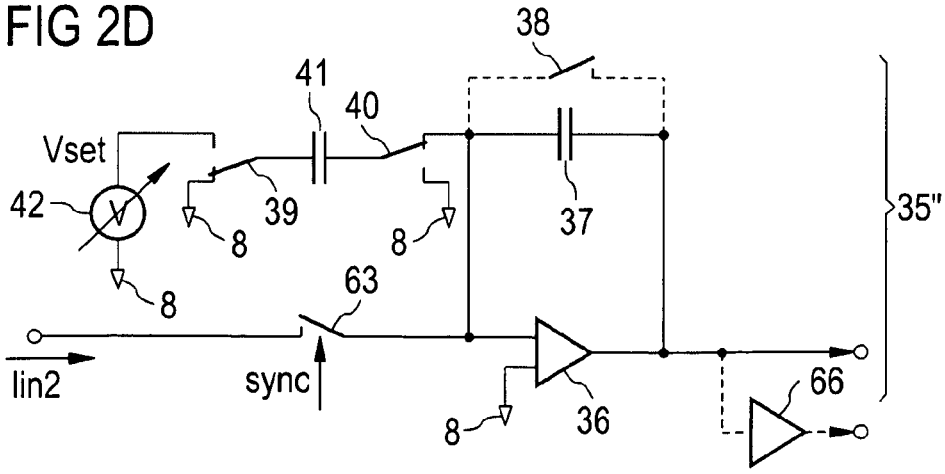

FIG. 2D shows a sampling circuit that comprises the switch 63, and a filter that comprises the integrator 35". The filter is realized using switched capacitor technology. The integrator 35" comprises, in turn, the amplifier 36, the capacitor 37, the switch 38, the additional capacitor 41, the change-over switches 39, 40, and a voltage source 42. The capacitor 37 and also the switch 38 are connected between the second input of the amplifier 36 and the output of the amplifier 36. The output of the amplifier 36 forms the output of the integrator 35". The first input of the amplifier 36 is connected to the reference-potential terminal 8. The second input of the amplifier 36 is connected via a series circuit, comprising the change-over switch 39, the additional capacitor 38, and the change-over switch 40, to the voltage source 42. The change-over switch 39 switches one electrode of the capacitor 41 between the voltage source 42 and the reference-potential terminal 8. The change-over switch 40 switches another electrode of the capacitor 41 between the second input of the amplifier 36 and the reference-potential terminal 8. In this way, only one of the two electrodes of the capacitor 41 is always connected to the reference-potential terminal 8.

A setting value Vset, which represents a default value for the associated light source, is provided to the voltage source 42. The integrator 35" thus allows the setting value Vset to be drawn from the photodetector current lin2. Accordingly, a preprocessed signal is already provided at the output of the integrator 35". The filter is constructed both for integration of the sampled photodetector current lin2 and also for determining a difference of the sampled photodetector current lin2 from the setting value Vset.

Figure 3A:
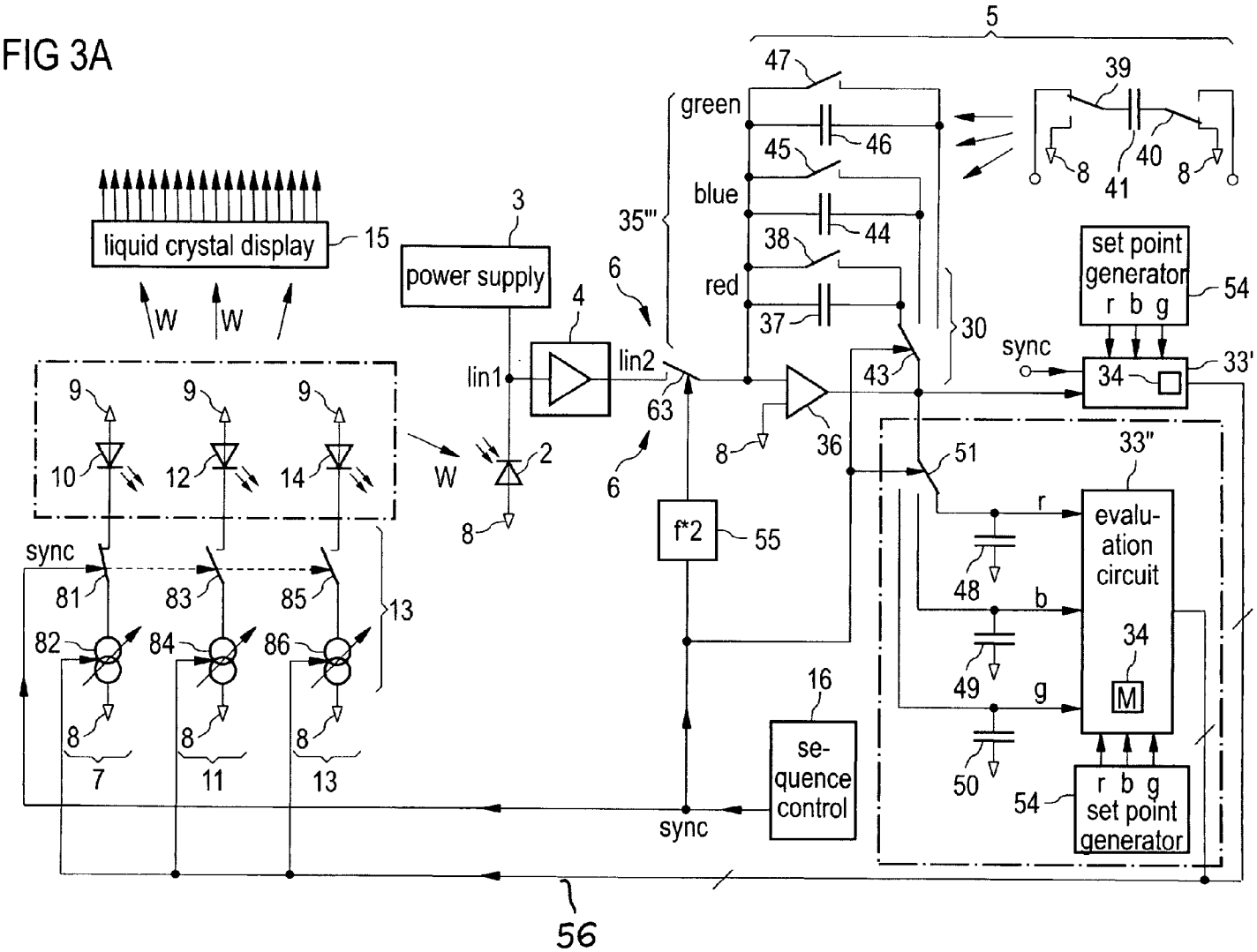
FIGS. 3A and 3B show another exemplary embodiment of a lighting arrangement according to the invention.

FIG. 3A shows another exemplary embodiment of a lighting arrangement. In contrast to the lighting arrangement in FIG. 1, the lighting arrangement in FIG. 3A comprises a frequency multiplier 55, which is inserted between the sequence controller 16 and the sampling means 6. The sampling means 6 has the first sampling circuit 60, which comprises the switch 63.

According to FIG. 3A, the control unit 5 comprises an integrator 35'", which is designed for the serial processing of several input signals. The integrator 35'" has the amplifier 36, which is connected at the first input to the reference-potential terminal 8 and at the second input to the output of the switch 63. The feedback branch of the amplifier 36 comprises three parallel circuits. A first parallel circuit has the capacitor 37 and the switch 38; a second parallel circuit has a capacitor 44 and a switch 45; a third parallel circuit has a capacitor 46 and a switch 47. One terminal of each of the three parallel circuits is connected to the second input of the amplifier 36. Another terminal of each of the three parallel circuits is coupled via a change-over switch 43 to the output of the amplifier 36 and thus to the output of the integrator 35'". If the first power-supply source 7 and thus the first light source 10 are activated, then the photodetector 2 receives a light signal and provides the photodetector current lin2. This is sampled, for example, by means of the switch 6 at twice the frequency of the control signal sync 3. During the sampling by means of the switch 63, the switch 38 is in an open state and the change-over switch 43 connects the output of the amplifier 36 to the parallel circuit, comprising the capacitor 37 and the switch 38. As a function of the light signal that the first light source 10 provides, the capacitor 37 in the integrator 35'" is charged. This value is fed to the evaluation circuit 33'.

The evaluation circuit 33' is connected at one input to the output of the amplifier 36 and at another input to the sequence controller 16. The three power-supply sources 7, 11, 13 are now activated alternately and the three capacitors 37, 44, 46 are charged. The voltage on the three capacitors 37, 44, 46 is thus fed time-shifted to the evaluation circuit 33' and compared by this to set points provided by the set-point generator 54. The three power-supply sources 7, 11, 13 are controlled in the following operating phase as a function of the comparison results.

Thus, a single amplifier 36 is advantageously sufficient for integration of the photodetector current lin2 with three different values, which occur as a function of the three light sources 10, 12, 14.

In an alternative embodiment, the switch 38 in the integrator 35'" can be replaced by the capacitor 41 and the two change-over switches 39, 40, as shown at the top right in FIG. 3A and similarly in FIG. 2C. Likewise, the two switches 45, 47 can be replaced by two other series circuits, which each comprise two change-over switches and a capacitor.

In another alternative embodiment of the lighting arrangement 3 according to FIG. 3A, the lighting arrangement comprises the block that is shown on the right side of FIG. 3A and is framed with a dashed line and comprises the three capacitors 48, 49, 50, the evaluation circuit 33", the set-point generator, and also the change-over switch 51. According to the alternative embodiment, the output of the integrator 35'Δ is connected via the change-over switch 51 to one of the capacitors 48, 49, 50. Because a control input of the change-over switch 51 is coupled with the sequence controller 16, an in-phase switching of the change-over switch 51 is performed, so that, on the capacitor 48, a signal is applied, which represents the value of the photodetector current lin2 generated by the first light source 10. This is performed accordingly for the second and third light source 12, 14 and the additional capacitors 49, 50. Thus, on the input of the control unit 33" three signals are applied, which represent the three values of the photodetector current lin2 generated as a function of the three light sources. In this alternative embodiment, the evaluation circuit 33' can be left out.

Figure 3B:
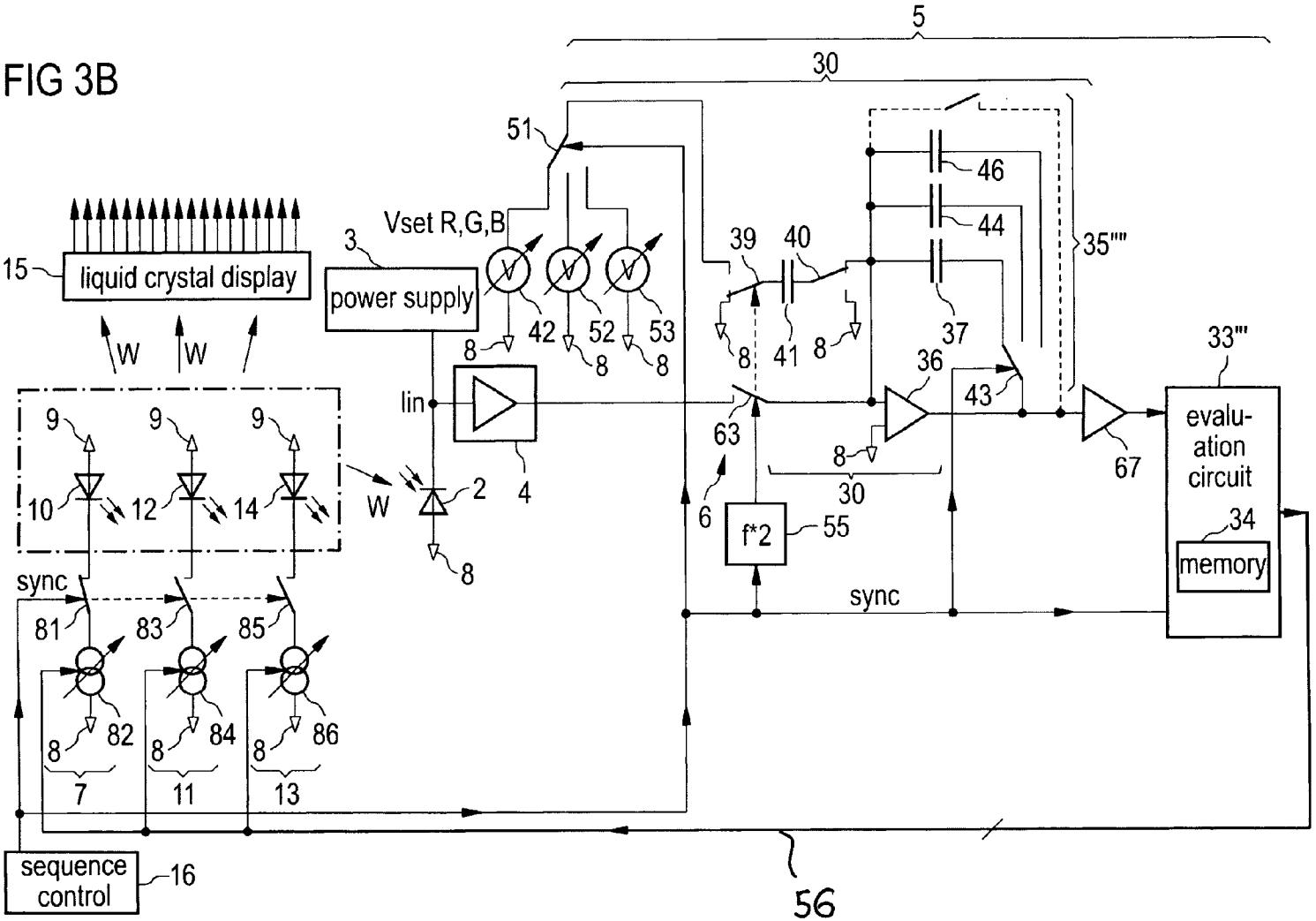

FIG. 3B shows another exemplary embodiment of a lighting arrangement, which presents an improvement of the lighting arrangement according to FIGS. 3A and 2D. In FIG. 3B as well, the sampling means 6 comprises the switch 63, which is connected to the sequence controller 16 via the frequency multiplier 55. The filter 35"" is realized using switched capacitor technology and has the amplifier 36. The feedback branch of the amplifier 36 connects the second input of the amplifier 36 to the output of the amplifier 36 and comprises the capacitors 37, 44, and 46, which can be selectively connected to the output of the amplifier 36 via the change-over switch 43. The second input of the amplifier 36 is connected via a series circuit, comprising the additional capacitor 41 and the two change-over switches 39, 40 and another change-over switch 51, to the voltage source 42, another voltage source 52, and an additional voltage source 53. The three voltage sources 42, 52, 53 represent default values for the first, the second, or the third light source 10, 12, 14. In this way, both the integration of the photodetector current lin2 and also the determination of a difference to a default value can advantageously be realized cost-efficiently by means of the switched capacitor technology.

Figure 4A:
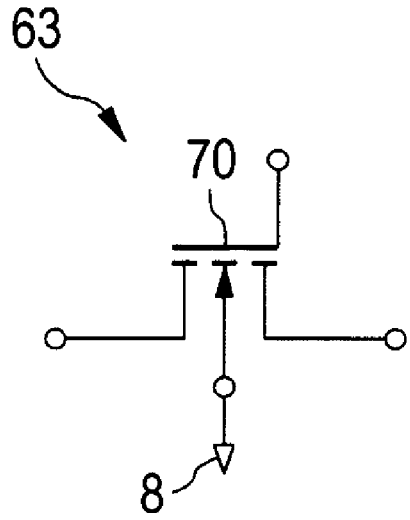
FIGS. 4A and 4B show exemplary embodiments of a sampling means.
Figure 4B:
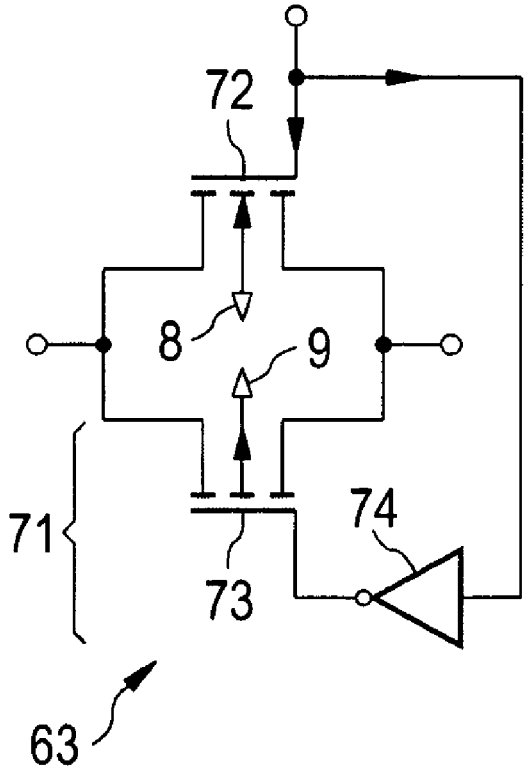

FIGS. 4A and 4B show exemplary embodiments of a sampling means of the type that can be used as the first, second, and third sampling circuits 60, 61, 63 in the FIGS. 1, 2A, to 2D, 3A, and 3B.

FIG. 4A shows a sampling means that comprises a switch 63. The switch 63 is constructed as a field-effect transistor 70, in particular, as an n-channel metal-oxide-semiconductor field-effect transistor, abbreviated n-channel MOS field-effect transistor. Alternatively, the field-effect transistor 70 can be constructed as a p-channel MOS field-effect transistor with an inverted switching signal.

FIG. 4B shows a sampling means that comprises a switch 63 realized as a transmission gate 71. The transmission gate 71 comprises an n-channel MOS field-effect transistor 72, a p-channel MOS field-effect transistor 73, and an inverter 74. A control terminal of the sampling means is connected to a control terminal of the n-channel MOS field-effect transistor 72 and via the inverter 74 to a control terminal of the p-channel MOS field-effect transistor 73. A first terminal of the n-channel MOS field-effect transistor 72 is connected to a first terminal of the p-channel MOS field-effect transistor 73. Likewise, a second terminal of the n-channel MOS field-effect transistor 72 is connected to a second terminal of the p-channel MOS field-effect transistor 73. By means of the transmission gate 71, switches can be realized with especially low on-state resistance values.

The scope of protection of the invention is not limited to the examples given hereinabove. The invention is embodied in each novel characteristic and each combination of characteristics, which includes every combination of any features which are stated in the claims, even if this combination of features is not explicitly stated in the claims.

The invention claimed is:

1. A circuit arrangement for controlling at least one light source, comprising:

a photodetector arranged to detect light from a first and a second light source;

an amplifier coupled to an output of the photodetector;

a sampling circuit coupled to an output of the amplifier;

a control unit, which comprises a first filter having an input coupled to the sampling circuit and an output coupled to a first and a second output of the control unit;

a first power-supply source, having a control input coupled to the first output of the control unit and which is adapted for controlling at least one parameter of the first light source; and a second power-supply source, having a control input coupled to the second output of the control unit and which is adapted for controlling at least one parameter of the second light source, wherein the sampling circuit comprises a transmission gate, wherein the first filter comprises an integrator, wherein the integrator comprises a further amplifier, a capacitor and a switch, wherein the switch and the capacitor are connected in a parallel circuit, wherein an input of the further amplifier is connected to the sampling circuit and to an output of the further amplifier via the parallel circuit, and wherein the output of the further amplifier forms an output of the integrator.

2. The circuit arrangement according to claim 1, wherein the output of the first filter is coupled to at least a third output of the control unit, and the circuit arrangement comprises a third power-supply source, having a control input coupled to at least the third output of the control unit and which has an output coupled to a third light source that generates light detected by the photodetector.

3. The circuit arrangement according to claim 2, wherein the sampling circuit comprises a first sampling circuit, which is coupled to the first power-supply source, and a second sampling circuit, which is coupled to the second power-supply source, and at least one third sampling circuit, which is coupled to at least one third power-supply source.

4. The circuit arrangement according to claim 2, wherein the first light source is connected to the first power-supply source, and the second light source is connected to the second power-supply source, and the third light source is connected to the third power-supply source.

5. The circuit arrangement according to claim 1, wherein the first filter is a low-pass filter.

6. The circuit arrangement according to claim 1, wherein the first filter comprises an amplifier.

7. The circuit arrangement according to claim 1, wherein the first filter comprises a switched capacitor.

8. The circuit arrangement according to claim 1, comprising a sequence controller, which is coupled to the sampling circuit and at least one of the first and second power-supply sources for outputting at least one control signal.

9. The circuit arrangement according to claim 1, wherein the photodetector comprises a photodiode, a phototransistor or a photoresistor.

10. The circuit arrangement according to claim 1, wherein the photodetector is coupled to a power-supply circuit for electrically powering the photodetector.

11. The circuit arrangement according to claim 1, wherein the sampling circuit comprises a first sampling circuit, which is coupled to the first power-supply source, and a second sampling circuit, which is coupled to the second power-supply source.

12. The circuit arrangement according to claim 11, wherein at least one of the sampling circuits comprises a sample-and-hold circuit.

13. The circuit arrangement according claim 1, wherein the control unit comprises a set-point generator.

14. The circuit arrangement according to claim 1, wherein the control unit comprises a memory for storing at least one measurement value of the photodetector current or at least one value derived from the one or more measurement values of the photodetector current.

15. The circuit arrangement according to claim 1, wherein the first power-supply source has an output coupled to the first light source, and the second power-supply source has an output coupled to the second light source.

16. The circuit arrangement according to claim 15, wherein the first power-supply source comprises a switch, to which, at a control input, a control signal is fed, and a current source, which is coupled on the input side to the control unit and is connected in series to the switch between the output of the first power-supply source and a reference-potential terminal.

17. The circuit arrangement according to claim 1, wherein the first light source is connected to the first power-supply source, and the second light source is connected to the second power-supply source.

18. A method for controlling at least one light source, comprising the steps of:

successive activation of a first and a second light source in an adjustment phase;

measurement, sampling, and filtering of a photodetector current allocated to each light source; and controlling a first power-supply source, which is connected to the first light source, and a second power-supply source, which is connected to the second light source, in an operating phase as a function of the values of the photodetector current sampled and filtered in the adjustment phase;

providing a control signal by a sequence controller to control, in the adjustment phase, a sequence of activation and deactivation of the first and second power-supply sources and the sampling of the photodetector current.

19. The method according to claim 18, comprising the steps of:

activating a third light source in the adjustment phase;

measuring, sampling, and filtering a photodetector current allocated to the third light source; and controlling, as a function of the value of the photodetector current sampled and filtered in the adjustment phase a third power-supply source, which is connected to the third light source, in an operating phase.

20. The method according to claim 19, comprising controlling the brightness of the third light source by influencing a current intensity or by pulse-width modulation or pulse-density modulation of a current, which is output by the third power-supply source to the third light source.

21. The method according to claim 18, comprising the steps of:

controlling the brightness of the first light source by influencing a current intensity or by pulse-width modulation or pulse-density modulation of a current, which is output by the first power-supply source to the first light source; and controlling the brightness of the second light source by influencing a current intensity or by pulse-width modulation or pulse-density modulation of a current, which is output by the second power-supply source to the second light source.

22. The method according to claim 18, comprising measuring and sampling the photodetector current allocated to each light source by the light signal, sampling the photodetector current, filtering and comparing with a default value.

23. The method according to claim 18, comprising generating the photodetector current with a common photodetector for the light sources.

24. The method according to claim 18, comprising filtering, in particular, holding and integrating, the photodetector current allocated to each light source with a switched capacitor.

25. A circuit arrangement for controlling at least one light source, comprising:

a photodetector arranged to detect light from a first and a second light source;

an amplifier coupled to an output of the photodetector;

a sampling circuit coupled to an output of the amplifier;

a control unit, which comprises a first filter having an input coupled to the sampling circuit and an output coupled to a first and a second output of the control unit;

a first power-supply source, having a control input coupled to the first output of the control unit and which is adapted for controlling at least one parameter of the first light source;

a second power-supply source, having a control input coupled to the second output of the control unit and which is adapted for controlling at least one parameter of the second light source; and a sequence controller, which is coupled to the sampling circuit and at least one of the first and second power-supply sources for outputting at least one control signal.

26. A circuit arrangement for controlling at least one light source, comprising:

a photodetector arranged to detect light from a first and a second light source;

a first amplifier coupled to an output of the photodetector;

a sampling circuit coupled to an output of the first amplifier;

a control unit, which comprises a first filter having an input coupled to the sampling circuit and an output coupled to a first and a second output of the control unit;

a first power-supply source, having a control input coupled to the first output of the control unit and which is adapted for controlling at least one parameter of the first light source; and a second power-supply source, having a control input coupled to the second output of the control unit and which is adapted for controlling at least one parameter of the second light source, wherein the first filter comprises an integrator, wherein the integrator comprises a second amplifier, a first capacitor, a second capacitor, a first change-over switch and a second change-over switch, wherein an input of the second amplifier is connected to an input of the first filter, wherein the first change-over switch, the second capacitor and the second change-over switch are connected in a series circuit with each other and in a parallel circuit with the first capacitor, wherein the parallel circuit connects the input of the second amplifier to the output of the second amplifier, and wherein the output of the second amplifier is connected to the output of the first filter.

* * * * *